US009546825B2

(12) United States Patent
Abker et al.

(10) Patent No.: US 9,546,825 B2
(45) Date of Patent: Jan. 17, 2017

(54) PLATE HEAT EXCHANGER

(75) Inventors: Gerd Abker, Marl (DE); Alfred Ernst, Mettmann (DE); Bernd Müller, Ratingen (DE); Klaus Mönig, Bottrop (DE)

(73) Assignee: Kelvion PHE GmbH, Sarstedt (DE)

( * ) Notice: Subject to any disclaimer, the term of this patent is extended or adjusted under 35 U.S.C. 154(b) by 274 days.

(21) Appl. No.: 13/620,769

(22) Filed: Sep. 15, 2012

(65) Prior Publication Data

US 2013/0277025 A1 Oct. 24, 2013

(30) Foreign Application Priority Data

Apr. 23, 2012 (EP) ..... 12165205

(51) Int. Cl.

| | |
|---|---|
| ***F28F 3/04*** | (2006.01) |
| ***F28D 9/00*** | (2006.01) |
| ***F28F 9/02*** | (2006.01) |
| ***F28F 13/08*** | (2006.01) |

(52) U.S. Cl.

CPC ..... *F28D 9/0037* (2013.01); *F28F 3/044* (2013.01); *F28F 9/0268* (2013.01); *F28F 13/08* (2013.01)

(58) Field of Classification Search

CPC ..... F28F 3/044; F28F 3/042; F28F 3/046; F28F 13/08; F28D 9/0068; F28D 9/0037

USPC ..... 165/165, 166

See application file for complete search history.

(56) References Cited

U.S. PATENT DOCUMENTS

| | | | | | |
|---|---|---|---|---|---|
| 2,097,851 | A | * | 11/1937 | Wenzl | F24F 1/0007 165/122 |
| 2,676,000 | A | * | 4/1954 | Ekwall | 165/167 |
| 2,777,674 | A | * | 1/1957 | Wakeman | F28F 3/046 165/167 |
| 3,517,733 | A | * | 6/1970 | Holmes et al. | 165/166 |
| 3,590,917 | A | * | 7/1971 | Huber et al. | 165/166 |
| 3,893,509 | A | * | 7/1975 | Satchwell et al. | 165/166 |
| 4,470,455 | A | * | 9/1984 | Sacca | 165/167 |
| 4,475,589 | A | * | 10/1984 | Mizuno et al. | 165/166 |

(Continued)

FOREIGN PATENT DOCUMENTS

| | | |
|---|---|---|
| DE | 41 42 177 C2 | 6/1993 |
| DE | 198 32 164 A1 | 1/2000 |

(Continued)

OTHER PUBLICATIONS

Gebhardt, EP0014863TRANS (English Translation), Sep. 1980.*
Bosne, EP0208042TRANS (English Translation), Jan. 1987.*

*Primary Examiner* — M. Alexandra Elve
*Assistant Examiner* — Eric Ruppert
(74) *Attorney, Agent, or Firm* — Gudrun E. Huckett

(57) ABSTRACT

A plate heat exchanger has flow channels through which a first flow and a second flow pass in concurrent or counter-current flow. The flow channels are formed for the first medium between individual plates (1) joined together to form in each case a pair (P) of plates, and for the second medium between pairs (P) of plates joined together to form a stack (S) of plates, wherein the individual plates (1) within an inlet region (E) have guide blades (2) which are formed by stamped embossments and protrude into the flow channel, wherein the guide blades (2) are formed in an arch-shaped manner with an inflow leg (21) aligned substantially parallel to the main flow direction and an outflow leg (22) aligned at an angle to the inflow leg (21).

10 Claims, 4 Drawing Sheets

(56) References Cited

U.S. PATENT DOCUMENTS

| | | | | |
|---|---|---|---|---|
| 5,301,747 | A * | 4/1994 | Daschmann et al. | 165/166 |
| 2006/0124287 | A1 * | 6/2006 | Reinders | 165/166 |
| 2011/0030829 | A1 | 2/2011 | Nilsson | |
| 2012/0227438 | A1 | 9/2012 | Ito et al. | |

FOREIGN PATENT DOCUMENTS

| | | | |
|---|---|---|---|
| DE | 10 2007 029 753 | A1 | 1/2009 |
| DE | 10 2010 006 277 | A1 | 7/2011 |
| EP | 0014863 | * | 9/1980 |
| EP | 0208042 | * | 1/1987 |
| EP | 0 495 184 | B1 | 7/1992 |
| GB | 2370348 | * | 6/2002 |
| JP | 10 103888 | A1 | 4/1998 |
| JP | 11 337376 | A1 | 12/1999 |
| KR | 2006 000 6159 | A1 | 1/2006 |

* cited by examiner

Section "A"

Section "B"

Section "C"

PLATE HEAT EXCHANGER

BACKGROUND OF THE INVENTION

The invention relates to a plate heat exchanger comprising flow channels through which a first and a second flow flows in concurrent or countercurrent flow, which flow channels are formed for the first medium between individual plates joined together to form in each case a pair of plates, and for the second medium between pairs of plates joined together to form a stack of plates, wherein the individual plates and the pairs of plates are connected to each other at longitudinal edges and support surfaces running parallel to the main flow direction, wherein each individual plate comprises inflow and outflow cross-sections arranged diagonally and corresponding in the longitudinal direction for the first medium, and inflow and outflow cross-sections adjacent thereto in the transverse direction for the second medium, wherein the outflow cross-sections for the first medium are in each case offset by half the height of the inflow and/or outflow cross-sections for the second medium, wherein the individual plate is provided with a profiling that generates turbulences.

Plate heat exchangers of this kind are used on a large scale with plate dimensions of several meters. A field of application here is the use in incinerators, power plants, chemical plants, refineries and/or the like, in which the resulting combustion heat of the flue gas is used for heating the second medium.

A plate heat exchanger according to the aforementioned type is disclosed in detail in German patent DE 41 42 177 C2. Here, for increasing the efficiency of the heat exchanger or, alternatively, for reducing the dimensions of the required individual plates, guide blades are provided which distribute the medium flowing in through the inflow cross-section over the full channel width of the flow channel. In order to avoid dead zones in the inlet region, in particular in the plate region located mirror-symmetrically adjacent to the longitudinal center, the guide blades are provided with elongated outflow legs which protrude beyond the longitudinal center of the individual plate. In addition, for equalizing the flow within the flow channel, the guide blades are arranged closer to the inflow cross-section in the longitudinal center of the individual plates than in the direction of the longitudinal edge of the individual plate. The turbulence-generating profiling, which covers a surface area of the individual plates that is as large as possible, serves for the same purpose.

Although this arrangement has proved itself in practice, there are still problems due to flow bypasses which form on the individual plate and which allow the heat medium to flow interaction-free along the profiling. This relates in particular to the edge regions of the individual plate. As a result of this, the heat flow rate of the plate heat exchanger decreases so that said heat exchanger needs correspondingly longer individual plates for a required performance.

It is therefore an object of the invention to provide a plate heat exchanger with which the interaction-free flow of heat medium through the individual plate is as low as possible, and therefore the heat flow rate at constant plate dimension increases.

SUMMARY OF THE INVENTION

As a technical solution for this object, a plate heat exchanger of the aforementioned kind is proposed, in which the turbulence-generating profiling is formed perpendicular to the main flow direction over the entire bottom up to the contact surfaces, and in the region of the contact surfaces, the individual plates have edge channels with a cross-section that is size-variable over the longitudinal extension of said edge channels.

Through this profiling, which extends over the entire width of the individual plate up to the lateral edges thereof, a controlled flow pattern is obtained while avoiding bypasses at the same time. In contrast to the prior art, it is therefore avoided that the medium flowing over the individual plate moves into profile-free channels and contributes to the heat exchange only to a minor extent. Overall, the profiling which, in contrast to the prior art, is brought closer to the lateral edge, therefore effects an improvement of the heat flow rate of the heat exchanger.

By downsizing the barrier-free bypasses, the edge channels according to the invention also result in an improved flow pattern so that, in turn, the heat flow rate of the heat exchanger is increased. The edge channels are formed in a labyrinthine manner and are formed in the region of the contact surfaces, i.e., in the edge region of the individual plates, where the heat medium otherwise would seek for a barrier-free and thus interaction-free flow path. The variation of the cross-section over the longitudinal extension of the edge channels provides that the medium flowing therethrough cannot continue to flow straight ahead and in a barrier-free manner, but is subject to a backup effect at the restrictions of the cross-section. Thus, an interaction-free medium flow through the edge channels of the individual plate and accordingly also performance loss is drastically reduced. This results in an increase of performance of up to 5% compared to the prior art. This performance increase can also be utilized for reducing the required plate length of the heat exchanger so that the same performance can be achieved with shorter individual plates.

Particularly advantageously, the edge channels are formed to be substantially S-shaped, i.e., multiple times S-shaped. This results in a staggered blocking embossment on both sides of each edge channel, which embossment leads to increased interaction of the heat medium due to the resulting restrictions and expansions. Said blocking embossment can be formed on one side or two sides of each edge channel, i.e., one side of a channel or two sides of a channel can be provided with corresponding stamped embossments.

Advantageously, the cross-section of the edge channels can vary up to 50% or more. As a result, the barrier-free cross-section for the medium is reduced at the restriction by more than half. In addition, in combination with the S-shaped configuration, a locally offset flow channel is created which further increases the interaction between medium and heat exchanger.

In combination with the configuration according to the invention of the turbulence-generating profiling extending into the respective edge region of each individual plate, the edge channel configuration according to the invention results in the synergetic effect that free flow paths for the medium are basically avoided. The media flowing into the plate heat exchanger therefore cannot divert via a bypass-like interaction-free flow-path. In contrast to the prior art, neither the bottom near the edge region of each individual plate nor the edge channel forming in the edge region between two individual plates represent according to the inventive configuration such a bypass because, according to the invention, the edge channels are formed in a labyrinthine manner and the turbulence-creating profiling extends up into the edge region of each individual plate. Thus, as a result, with an unchanged plate size, performance increase can be achieved, or, with the same performance, a downsized plate size can be achieved. There is no example for such a configuration in the prior art.

The invention provides that the inflow legs and the outflow legs are arranged at an angle between 140° and 100°, preferably 135° and 112°, relative to each other. The shorter the guide blades, the steeper inflow legs and outflow legs can be arranged relative to each other. Through the combination with an inflow leg aligned substantially parallel to the main flow direction, angles of up to 90° are possible without the risk of clogging the inflow cross-sections with accumulations of foreign matters on the guide blades.

It is recommended that the individual plates within an inlet region comprise guide blades formed by stamped embossments protruding into the flow channel, wherein the guide blades are formed in an arch-shaped manner with an inflow leg aligned substantially parallel to the main flow direction and an outflow leg aligned at an angle to the inflow leg, wherein the turbulence-generating profiling of the individual plates comprises stamped knobs. Said knobs can be produced in a very simple and cost-effective manner by stamping the individual plates. Moreover, a uniform knob field is perfectly suited for increasing performance of the heat exchanger. Through the turbulent flow, heat transfer is increased and therefore efficiency is improved.

Moreover, some of the knobs can be formed as spacers for adjacent individual plates. In this manner, even in the case of small distances between adjacent individual plates, the predefined plate spacing can be ensured over the entire channel length and channel width. Such spacers can also be formed in the region of the guide blades so as to keep the individual plates in the region of the inflow and outflow cross-sections at the predefined distance from each other. Of course, it is also possible that all knobs serve as spacers.

In addition, it is proposed that the guide blades of the inflow cross-sections do not protrude beyond the longitudinal center of the individual plates, i.e., the guide blades are formed exclusively in the plate halves associated with the respective inflow cross-sections, wherein the inflow legs and the outflow legs have substantially identical lengths, and wherein the inflow legs of the guide blades are in each case arranged at the individual plates' transverse edges running substantially perpendicular to the main flow direction. Due to the guide blades which are shorter and arranged steeper relative to the main flow direction and closer to edge, adherence of dirt particles is minimized. In this manner, clogging of the inflow cross-sections is reliably prevented, which otherwise would result in expensive cleaning.

It is further proposed that in the region of the inflow cross-sections, the turbulence-generating profiling protrudes up to the guide blades and is recessed in the region of the outflow cross-sections. Due to this profile recess in the plate half located next to the inflow cross-section, negative pressure is created with respect to the gas pressure inside the profiled inflow cross-section so that the inflowing flue gases are sucked into the profile-free region. Thus, a homogenous distribution of the inflowing medium over the entire width of the plate is effected, which, in turn, has a positive influence on the performance of the plate heat exchanger.

The configuration according to the invention of the guide blades, on the one hand, and the configuration according to the invention of the profiling generating the turbulences, on the other, in combination result in the synergetic effect that equalization of the media flowing into the heat plate takes place over the entire plate width while minimizing at the same time the risk of contamination which, in the worst case, causes clogging of the guide blades. In contrast to the prior art according to the aforementioned DE 41 42 177 C2, the invention deliberately departs from the previous configuration and proposes to downsize the guide blades, in particular with regard to the respective outflow leg. Moreover, by deliberately departing from the aforementioned prior art, the number of guide blades has been significantly reduced. The deterioration of the medium equalization, as a result of these measures, to be feared according to the explanations in DE 41 42 177 C2, surprisingly did not occur or was compensated in combination with the configuration of the turbulence-generating profiling. The result of the configuration according to the invention is increased efficiency over the prior art with regard to the distribution of the medium, and, at the same time, reduction of the guide-blade-related contact surfaces for dirt particles, foreign substances and/or the like is achieved. As a result, in contrast to the previously known plate heat exchangers, the plate heat exchanger according to the invention is less prone to contamination or even clogging, so that operational safety is increased and/or the maintenance intervals can be extended. A particularly positive effect in this connection has the fact that in contrast to the prior art, the outflow legs of the guide blades according to the invention are formed much steeper and much shorter.

Advantageously, the guide blades are completely stamped through so that they rest without any gap against the adjacent individual plate. Through this configuration, the guide blades serve completely as a support or a spacer so that vibrations within the pair of plates and within the plate stack are reduced and thus the structure of the heat exchanger overall becomes more stable. Depending on the configuration, the guide blades, which are completely stamped through, can rest against the guide blades of adjacent individual plates or against the opposing wall of the flow channels.

BRIEF DESCRIPTION OF THE DRAWINGS

Further features and advantages of the invention arise from the following description by means of the figures.

DESCRIPTION OF PREFERRED EMBODIMENTS

Figure 1:
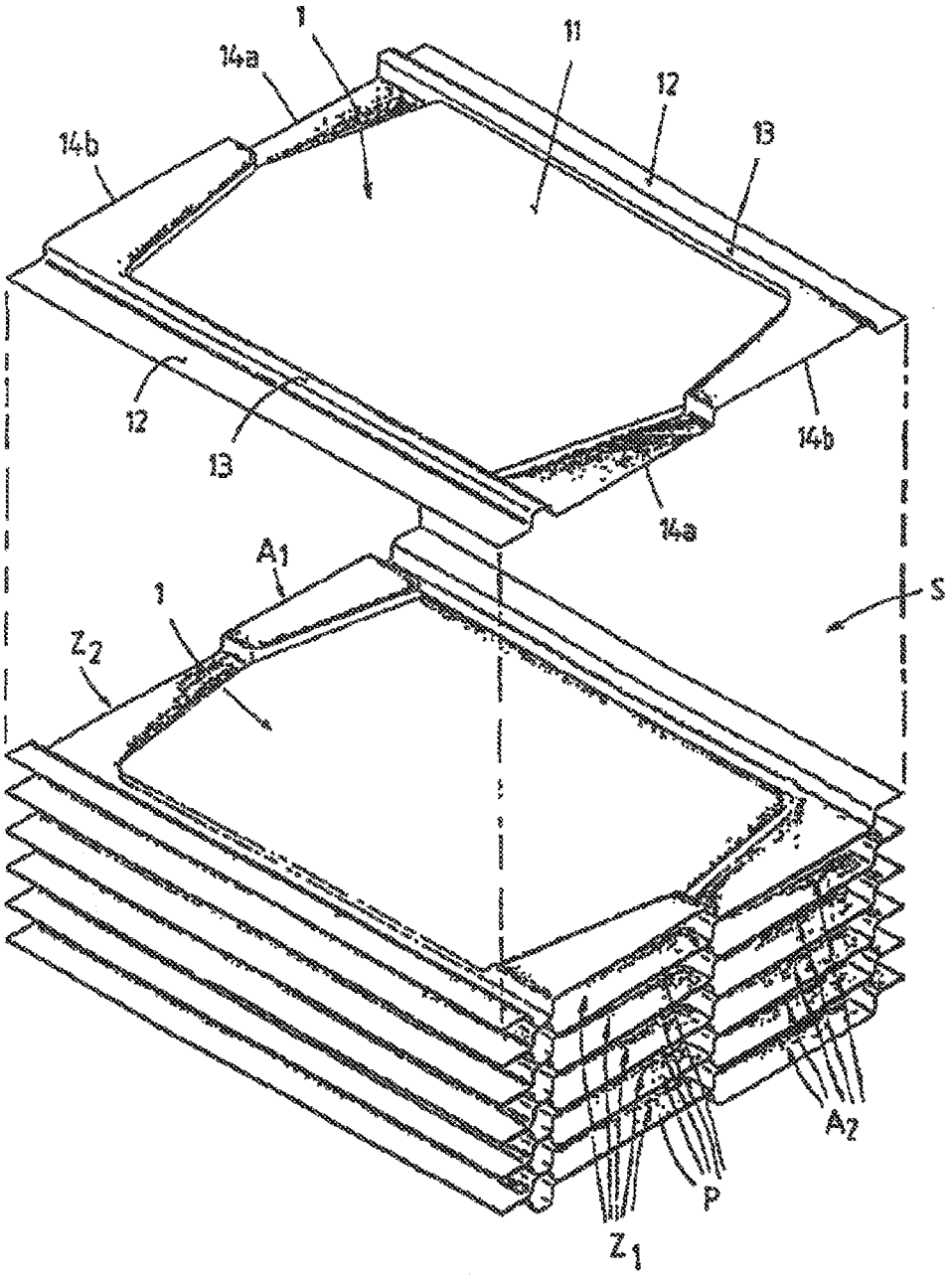
FIG. 1 shows a perspective view of a plate stack formed from a plurality of individual plates, wherein for a better overview, the guide blades and the profiling are not illustrated.

The exemplary embodiment of a plate heat exchanger schematically illustrated in FIG. 1 shows perspectively a plate stack S from a plurality of individual plates 1 which are in each case connected to each other so as to form a pair P of plates. Each individual plate 1 comprises a bottom 11 which lies in a different plane than the longitudinal edges 12. Subsequent and parallel to these longitudinal edges 12, each individual plate 1 is formed with a contact surface 13 which is offset in height with respect to the longitudinal edges 12. The offset between the contact surface 13 and the associated longitudinal edge 12 is twice as large as the offset between the longitudinal edges 12 and the bottom 11. Accordingly, the bottom 11 is positioned at the middle of the height between the plane of the longitudinal edges 12 and the plane of the contact surfaces 13. In the exemplary embodiment, the edges running transverse to the longitudinal edges 12 of the individual plate 1 lie approximately half in the plane of the longitudinal edges 12 or in the plane of the contact surfaces 13, respectively. In this manner, the transverse edges 14*a* and 14*b* are created which are offset relative to each other in height, i.e., perpendicular to the surface of the bottom 11, by the same amount as the planes in which the longitudinal edges 12 lie, on the one hand, and the contact surfaces 13, on the other. FIG. 1 clearly shows that here, the transverse edges 14*a* and 14*b* oppose each other diagonally.

In each case two of the individual plates 1 illustrated in FIG. 1 as the uppermost part are connected according to the bottom illustration in FIG. 1 so as to form pairs P of plates. FIG. 1 exemplary illustrates five complete pairs P of plates, wherein on top of the uppermost pair of plates, an additional individual plate 1 is arranged which is also connected to the uppermost individual plate 1 shown spaced apart so as to form a pair P of plates.

When the pairs P of plates are connected in the region of the contact surfaces 13 so as to form a plate stack S, this results in channels arranged on top of each other for the two media involved in the heat exchange. While the one medium flows in the flow channels which are formed in each case by the pairs P of plates, the other medium flows in the flow channels which are formed by joining the pairs P of plates together so as to form the plate stack S. Here, the individual plates' 1 transverse edges 14*a* lying in the plane of the longitudinal edges 12 form the inflow cross-section Z1 or, respectively, the outflow cross-section A1 of the flow channels for the medium flowing between the pairs P of plates. The individual plates' 1 transverse edges 14*b* extending in the plane of the contact surfaces 13 form the inflow cross-sections Z2 or, respectively, the outflow cross-sections A2 for the other medium which flows between the individual plates 1 of each pair P of plates in the same direction or in the direction counter to the first medium. FIG. 1, which shows a countercurrent heat exchanger, illustrates that due to the diagonal arrangement of the inlet and outlet openings, the inflow cross-sections Z1 and Z2, respectively, for the one medium are located next to outflow cross-sections A2 and A1, respectively, for the other medium, namely offset in each case by half the height of a pair P of plates.

Figure 2A:
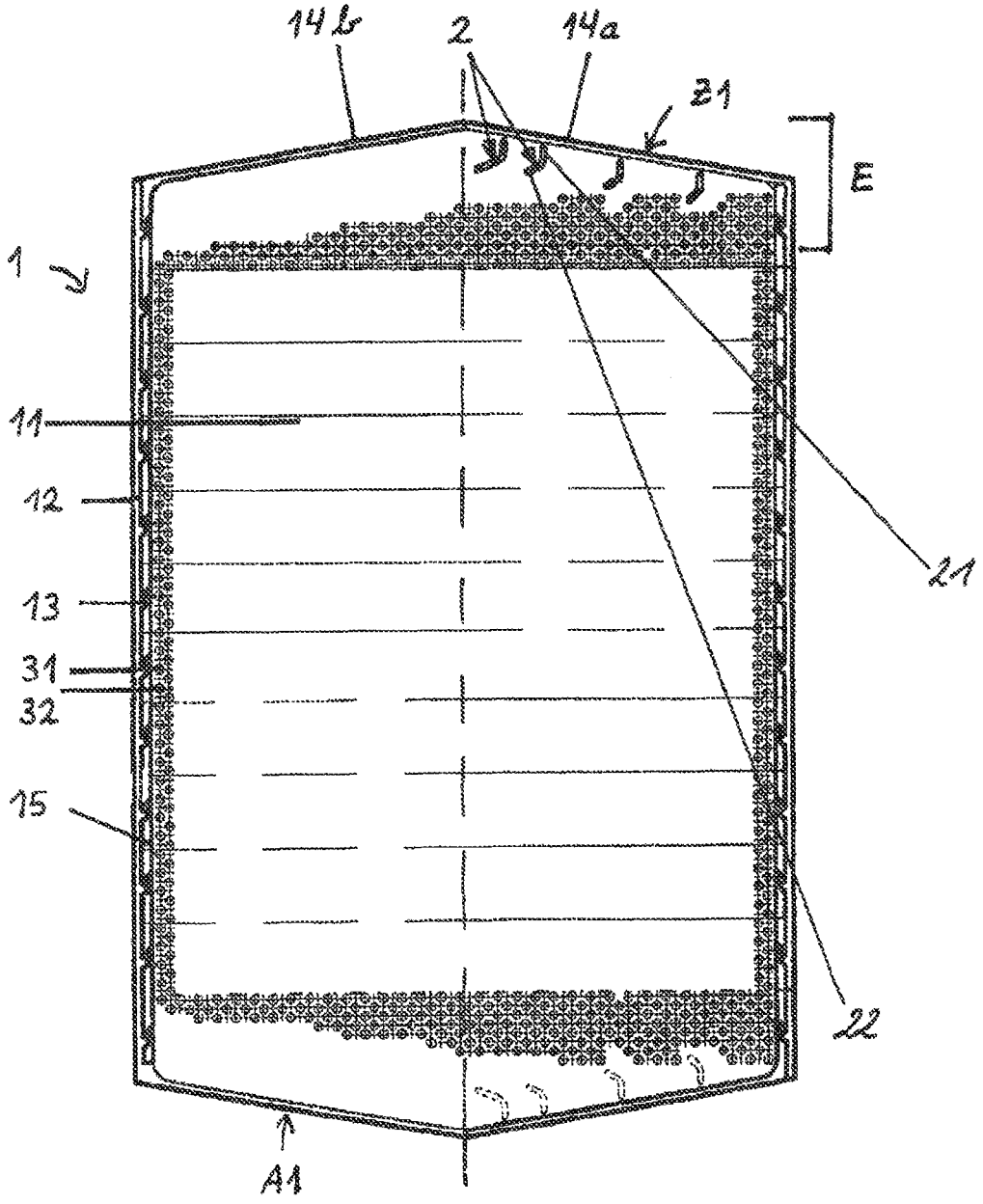
FIG. 2*a* shows a top view of an individual plate with guide blades and indicated profiling.

FIG. 2*a* shows an individual plate 1 according to the invention, the inflow cross-section Z1 of which extends over half the width of the individual plate 1, from the longitudinal center up to the longitudinal edge 12. The individual plate has an inlet region E, the length of which in the main flow direction characterizes the path which the inflowing medium requires to spread over the full width of the individual plate 1. In the image plane, four guide blades 2 are arranged to the right of the longitudinal center of the individual plate 1, each of which comprises one inflow leg 21 and one outflow leg 22. The inflow legs 21 and outflow legs 22 are approximately of the same length and enclose an angle of approximately 140° to 100° between them. None of the outflow legs 22 protrudes beyond the longitudinal center of the individual plate 1. The inflow legs 21 are in each case attached in close vicinity to the transverse edge 14*a*. The individual plate 1 has a turbulence-generating profiling 31, 32 which extends over the entire width of the individual plate up to the contact surfaces 13. Said profiling 31, 32 consists of a high number of knobs 31, 32 stamped into the individual plates 1, which knobs extend in the region of the inflow cross-section Z1 up to the guide blades 2 and are recessed in the region to the left of the longitudinal center.

With regard to the image plane according to FIG. 2, S-shaped edge channels 15 are formed in the region of the contact surfaces 13, said channels having a cross-section that is size-variable over their longitudinal extension.

Figure 2B:
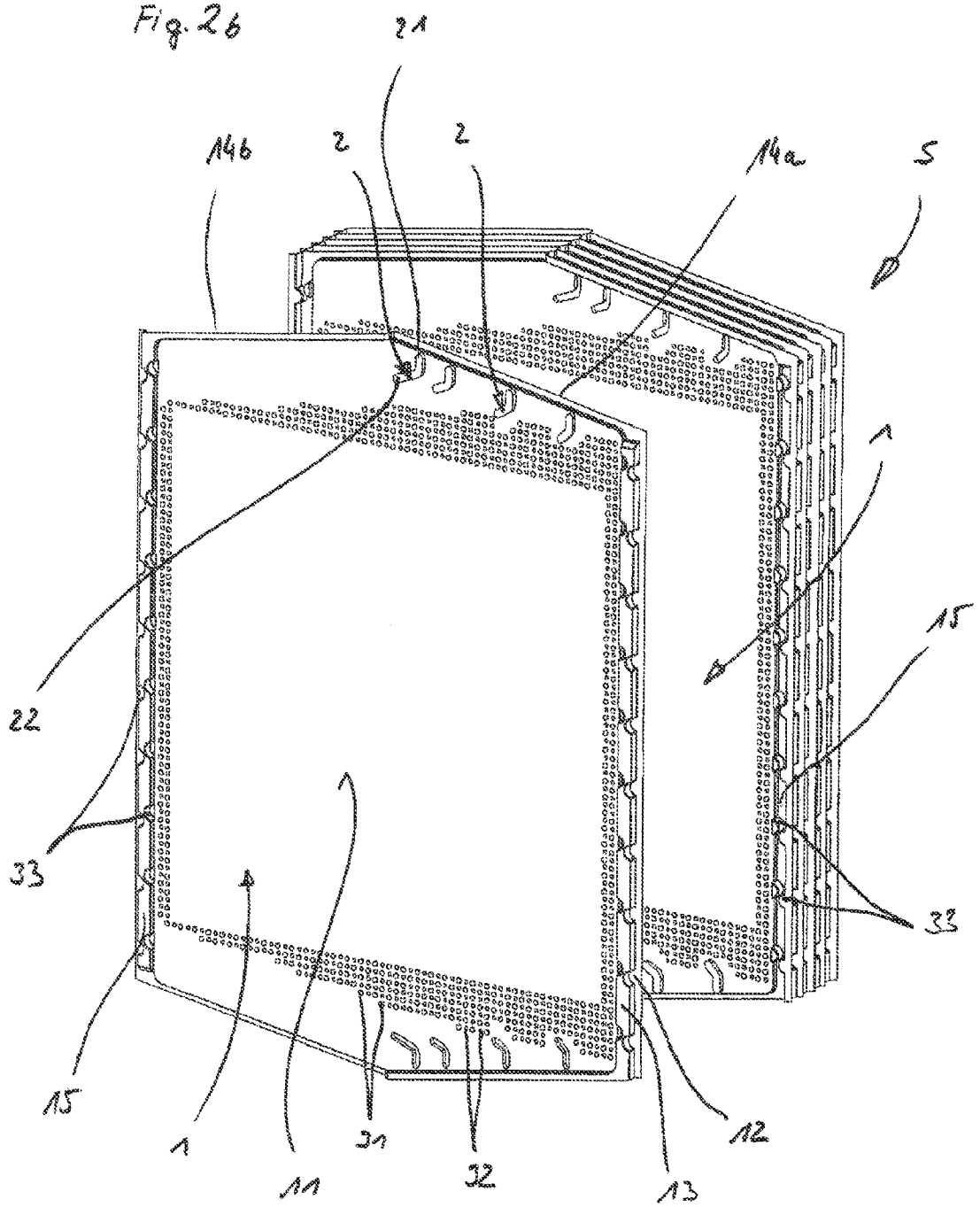
FIG. 2*b* shows a perspective view of a plate stack formed according to FIG. 2*a* from a plurality of individual plates.

FIG. 2*b* shows a perspective view of a plate stack S formed from a plurality of individual plates 1. The interaction of the individual plates 1 is clearly visible in this illustration.

Figure 3:
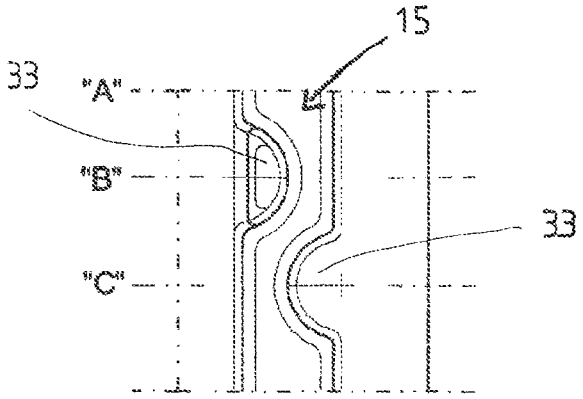
FIG. 3 shows an enlarged detailed illustration of an S-shaped edge channel.
Figure 4A:
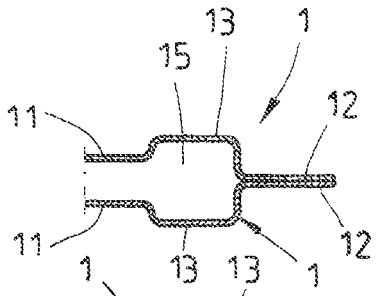
FIG. 4*a* shows a sectional view according to section "A" of the S-shaped edge channel.
Figure 4B:
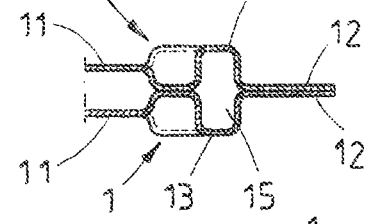
FIG. 4*b* shows a sectional view according to section "B" of the S-shaped edge channel.
Figure 4C:
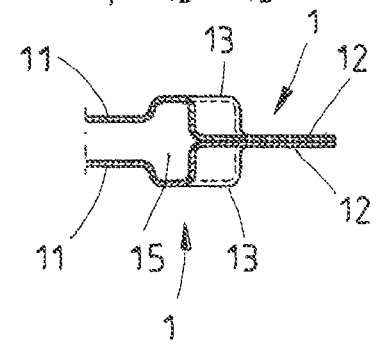
FIG. 4*c* shows a sectional view according to section "C" of the S-shaped edge channel.

FIG. 3 shows such an edge channel 15 in an enlarged top view. FIGS. 4*a*, 4*b* and 4*c* show sectional views of this edge channel 15 at different sections A, B and C according to FIG. 3. It can be seen that the cross-section through which the medium flows is at its maximum at the position A, whereas the cross-section at the positions B and C is in each case less than 50% of the maximum cross-section, wherein the cross-section at the positions B and C is in each case narrowed on different sides of the edge channel 15. Here the restrictions result from stamped embossments which, with regard to the image plane according to FIG. 3, are shaped as a partial circle, so that in the longitudinal direction, the overall S-shaped course of the channel is obtained.

The invention functions such that the heat medium, here the flue gas, flowing through the inflow cross-section Z1 into the individual plate 1, impinges onto the guide blade's 2 inflow legs 21 immediately adjacent to the transverse edge 14*a*. From there, the flue gas is guided onto the outflow legs 22 which are arranged at an angle of approximately 140° to 100° relative to the inflow legs 21. Due to the fact that the inlet region E in the region of the inflow cross-section Z1 has a profiling 31, 32 arranged immediately subsequent to the guide blades 2 while there is no profiling 31, 32 in the inlet plate's 1 region located mirror-symmetrically on the left next to the longitudinal center, a pressure distribution develops above the profiling 31, 32 within the inlet region E, which pressure distribution sucks the inflowing flue gas from the guide blades 2 into the profile-free region. In this manner, the flue gas is uniformly distributed over the width of the plate and provides for a homogenous heat flow rate over the entire inlet plate 1 of the heat exchanger. Due to the particularly short and steep configuration of the guide blades 2, adherence of dirt particles on the guide blades 2 is reduced so that clogging of the inflow cross-section Z1 is prevented. Therefore, all in all, a low-maintenance plate heat exchanger is created which is not subject to a performance loss.

According to an embodiment variant, the individual plate 1 can comprise, in addition to the above-illustrated measures, edge channels 15 which, for the purpose of forming a labyrinth, comprise stamped embossments 33. Here, the medium reaching the edge region of the individual plate 1 flows through the edge channels 15 and arrives at the restrictions and expansions of the respective channel cross-sections which cause a backup effect and result in an increased interaction of the medium with the individual plate 1. As shown in FIG. 3, the flue gas gets into the S-shaped edge channels 15 where the whole channel cross-section is available in the section area A (view FIG. 4*a*). In the region of section B (view FIG. 4*b*), the flue gas has to flow through the first curve in which the cross-section is reduced by half. In the course of this, the aforementioned backup effect is generated. Downstream of the curve, the cross-section expands again temporarily and decreases again in the region of section C (FIG. 4*c*) to half the cross-section; however, here it follows the S-shape of the edge channel 15 in the region of the opposing channel side wall. Therefore, all in all, performance losses which, according to the prior art, occur due to bypasses in the edge region of the individual plate 1, are considerably reduced through higher interaction of the heat medium with the individual plates 1, which, in turn, results in increased performance of the heat exchangers. This effect can be enhanced in that the turbulence-generating profiling 31, 32 is formed over the entire width of the individual plates 1 up to the contact surfaces 13. This facilitates avoiding bypasses and therefore results in improved performance of the heat exchanger.

LIST OF REFERENCE CHARACTERS

A Outlet region
A1 Outflow cross-section
A2 Outflow cross-section
E Inlet region
P Pair of plates
S Plate stack
Z1 Inflow cross-section
Z2 Inflow cross-section
1 Individual plate
11 Bottom
12 Longitudinal edge
13 Contact surface
14*a* Transverse edge
14*b* Transverse edge
15 Edge channel
2 Projection
21 Inflow leg
22 Outflow leg
31 Individual knob
32 Individual knob
33 Stamped embossment

What is claimed is:

1. A plate heat exchanger comprising flow channels through which a first and a second flow flows in concurrent or countercurrent flow, which flow channels are formed for a first medium between individual plates (1) joined together to form pairs (P) of plates, respectively, and for a second medium between the pairs (P) of plates joined together to form a stack (S) of plates, wherein the individual plates (1) and the pairs (P) of plates are connected to each other at longitudinal edges (12) and contact surfaces (13) running parallel to a main flow direction, wherein the stack of plates comprises inflow and outflow cross-sections (Z1, Z2, A1, A2), arranged diagonally and corresponding in a longitudinal direction, for the first medium and inflow and outflow cross-sections (Z1, Z2, A1, A2), adjacent thereto in a transverse direction, for the second medium, wherein the inflow and outflow cross-sections (Z1, Z2, A1, A2) for the first medium are in each case offset by half the height of the inflow and outflow cross-sections (Z1, Z2, A1, A2) for the second medium, wherein the individual plate (1) is provided with a profiling (31, 32) that generates turbulences, wherein the profiling (31, 32) is formed perpendicular to the main flow direction over the entire bottom (11) up to the contact surfaces (13), and in a region of the contact surfaces (13), the individual plates (1) are shaped to form edge channels (15) that are arranged between the flow channels and the longitudinal edges (12), respectively, the edge channels delimited in a direction parallel to a stacking direction of the individual plates by opposed upper and lower boundary walls extending in the longitudinal direction, wherein the opposed upper and lower boundary walls of each edge channel each are shaped to provide the respective edge channel with at least two blocking embossments staggered relative to each other over a longitudinal extension of the edge channels, wherein a first one of the blocking embossments is located on a first side of the edge channel facing the flow channels and extends into the interior of the edge channel in a direction toward the longitudinal edge, and wherein a second one of the blocking embossments is located on a second side of the edge channel, opposite the first side and facing the longitudinal edge, and extends into the interior of the edge channel in a direction toward the first side of the edge channel, wherein the blocking embossments each consist of a first embossment member and a second embossment member, wherein the first embossment member is provided by the upper boundary wall and the second embossment member is provided by the lower boundary wall, wherein, viewed in a cross-sectional view, the blocking embossments each extend across the full height of the edge channel and over at least 50% of the width of the edge channel measured from the first side to the second side, wherein the blocking embossments each are shaped as a circle segment and a sagitta of the circle segment equals half of said width of the edge channel or is greater than half of said width of the edge channel, wherein the at least two staggered blocking embossments generate in the edge channels a cross-sectional area having a cross-sectional size that varies over said longitudinal extension, respectively.

2. The plate heat exchanger according to claim 1, wherein the edge channels (15) are formed to be S-shaped or multiple times S-shaped.

3. The plate heat exchanger according to claim 1, wherein the individual plates (1) within an inlet region (E) comprise guide blades (2) formed by stamped embossments protruding into the flow channel, wherein the guide blades (2) are formed in an arch shape with an inflow leg (21) aligned substantially parallel to the main flow direction and an outflow leg (22) aligned at an angle to the inflow leg (21), wherein the inflow legs (21) and the outflow legs (22) are arranged at an angle between 140° and 100° relative to each other.

4. The plate heat exchanger according to claim 3, wherein the inflow legs (21) and the outflow legs (22) are arranged at an angle between 135° and 112° relative to each other.

5. The plate heat exchanger according to claim 3, wherein the guide blades (2) of the inflow cross-sections (Z1, Z2) do not protrude beyond a longitudinal center of the individual plates (1), wherein the inflow legs (21) and the outflow legs (22) have identical lengths, and wherein the guide blades (2) are arranged at the same distance from the associated transverse edge (14*a*, 14*b*) of the respective individual plate (1).

6. The plate heat exchanger according to claim 3, wherein the inlet region is divided relative to a longitudinal center of the individual plates into a first region and a second region, wherein the first and second regions each have a peripheral contour and the peripheral contours are mirror-symmetrical to each other relative to the longitudinal center of the individual plates and wherein the guide blades are arranged only in the first region and not in the second region, wherein the profiling (31, 32) protrudes in the first region up to the guide blades (2) and the second region is free of the profiling.

7. The plate heat exchanger according to claim 3, wherein the guide blades (2) are completely stamped through so that the guide blades (2) rest without any gap against the adjacent individual plate (1).

8. The plate heat exchanger according to claim 7, wherein the guide blades (2) as spacers serve for supporting.

9. The plate heat exchanger according to claim 1, wherein the profiling (31, 32) has stamped knobs (31, 32).

10. The plate heat exchanger according to claim 9, wherein some of the stamped knobs (31, 32) are formed as spacers for adjacent individual plates (1).

* * * * *